US005220340A

United States Patent [19]

Shafai

[11] Patent Number: 5,220,340

[45] Date of Patent: Jun. 15, 1993

[54] DIRECTIONAL SWITCHED BEAM ANTENNA

[76] Inventor: Lotfollah Shafai, 604 Kilkenny Drive, Winnipeg, Manitoba, Canada, R3T 3E1

[21] Appl. No.: 875,649

[22] Filed: Apr. 29, 1992

[51] Int. Cl.[5] ..... H01Q 1/36

[52] U.S. Cl. ..... 343/895

[58] Field of Search ..... 343/895, 810, 857, 739, 343/740, 853

[56] References Cited

U.S. PATENT DOCUMENTS

| | | | |
|---|---|---|---|
| 3,039,099 | 6/1959 | Chait et al. | 343/851 |
| 3,344,425 | 6/1966 | Shelton | 343/895 |
| 3,624,658 | 11/1971 | Voronoff | 343/895 |
| 3,828,351 | 8/1974 | Voronoff | 343/895 |
| 3,949,407 | 4/1976 | Jagdmann et al. | 343/895 |
| 4,309,706 | 1/1982 | Mosko | 343/895 |
| 4,947,178 | 8/1990 | Shafai | 343/700 |

*Primary Examiner*—Rolf Hille
*Assistant Examiner*—Tan Ho
*Attorney, Agent, or Firm*—Thomas Adams

[57] ABSTRACT

A switched beam antenna comprising several spiral arms with a common axis of rotation and respective inner ends angularly spaced around a common circle generates high gain directional beams at an angle away from the antenna axis. Beam scanning is accomplished by rotating the feed to the arms by means of a commutator circuit. Intermediate beams may be generated by feeding two adjacent antenna terminals simultaneously but with an appropriate phase shift. A comparator may be provided to compare signals from several arms and select the arm yielding maximum signal strength.

23 Claims, 9 Drawing Sheets

DIRECTIONAL SWITCHED BEAM ANTENNA

FIELD OF THE INVENTION

This invention relates to antennas and especially to beam scanning antennas.

Embodiments of the invention may comprise a single high gain antenna element, or an array of elements, and be fed from a radio frequency source for radiating electromagnetic energy or connected to a receiver for reception of such energy.

Hence, in this specification, references to "antenna beam" should be interpreted, where appropriate, to include "antenna sensitivity lobe" since the antenna can be used for transmission or reception.

BACKGROUND

A common form of beam scanning antenna is the so-called phased array antenna which comprises an array of antenna elements each with an associated phase shifter for changing the phase of the excitation signal. Varying the phase shift for different elements causes the beam to rotate or scan.

L. Shafai's U.S. Pat. No. 4,947,178, issued Aug. 7, 1990, the entire disclosure of which is incorporated herein by reference, discloses such a beam scanning antenna that generates a high gain beam using azimuthal modes. The antenna arrays for radiating these azimuthal modes comprise stacked microstrip disks or circular slots, that are fed separately from a radio frequency source, through a power divider. Beam scanning is accomplished by introducing appropriate phase shifts between the radiating azimuthal modes, i.e. the microstrip disks or slots. A disadvantage of such an antenna is that all of the separate feed circuits must be modified simultaneously, which requires relatively complex control circuitry, and the antenna is quite costly to make.

Multiple arm spiral antennas have been disclosed which are fed at the inner or outer arm ends. Such spiral antennas may require less complex control circuit and be simpler and less costly to make. As disclosed in U.S. Pat. No. 3,039,099 (H.N. Chait et al) and in U.S. Pat. No. 3,949,407 (K.M. Jagdmann and H.R. Phelan), the entire disclosures of which are incorporated herein by reference, when two opposing arms of a spiral antenna are fed with antiphase currents, currents will flow along the arms until they become in-phase at a place called the active region, where the radius is equal to $\lambda/2\pi$, where $\lambda$ is the wavelength. During this condition an efficient radiation takes place, generating a beam along the rotation axis of the spiral. This radiation corresponds to the radiation field of the first azimuthal mode. When the antenna has N arms, feeding them at the inner or outer terminals by a progressive phase difference of $2\pi/N$, thereby resulting in a total phase rotation at N-arms of $2\pi$, again excites the first azimuthal mode that radiates along the antenna axis. Conversely, feeding the antenna arms with a progressive phase difference of $2\pi m/N$, when m is an integer, thereby resulting in a total phase difference of $m2\pi$ between the N arms, excites the $m^{th}$ azimuthal mode. This $m^{th}$ mode radiates an omni-directional pattern with a null along the antenna axis. Feeding all arms, exciting one mode, gives broadband characteristics useful for direction finding and wideband communication, but none of these modes alone generate a directional beam away from the antenna axis.

In the field of direction finding, 4-arm spiral antennas have been disclosed in which a feed network combines the received signals of all four arms at appropriate phases to extract the power of the first two modes. For the first mode, the phase relationships are 0°, 90°, 180°, 270° and for the second mode they are 0°, 180°, 360°, 540°. The combining network adds and subtracts the signals of these two modes to determine the direction of arrival of the radio frequency wave. Generally, such direction finding antennas have a broadband frequency range which renders them unsuitable for many communications applications where a narrow beam is required, for example to communicate with a satellite.

The present invention seeks to eliminate or at least mitigate the foregoing disadvantages and provide an improved beam scanning antenna which is especially suitable for communications.

SUMMARY OF THE INVENTION

According to the present invention, an antenna comprises a plurality of spiral conductive arms having a common axis of rotation and their respective inner ends spaced angularly about such axis, preferably at substantially equal intervals, and means for communicating radio frequency signals via one end of a selected one or more, but not all, of said arms, respective outer ends of the spiral arms defining a periphery of the antenna, the span of the antenna being such that each arm extends through a series of active regions wherein, when the antenna is communicating radio frequency signals at a predetermined operating wavelength, radiation occurs, the active regions being disposed at successive increasing radii which are proportional to said wavelength, the winding rate of each antenna arm being such that its electrical length between two consecutive crossings of active regions is substantially equal to its electrical length between two previous consecutive active region crossings plus an integer multiple of said wavelength.

For convenience, the inner ends of the remaining arms, and the outer ends of all arms, may be open-circuit or shorted to ground.

Such an antenna will produce several sets of active regions, the number of sets being equal to the number of spiral arms and each set disposed at a different diameter, resulting in a single high gain beam or lobe directed away from the rotation axis of the antenna.

In preferred embodiments of the invention, the multiple is equal to the number of said spiral arms and the periphery is substantially circular, the diameter of the spiral array then being substantially equal to $N\lambda/2\pi$.

The means for communicating radio frequency may feed the signals to the antenna arm or arms or receive signals via the arm or arms, or both, depending upon whether the antenna is being used with a transmitter, receiver, or transceiver.

The radio frequency signal may be communicated via at least two adjacent spiral arms, with a suitable phase relationship therebetween. Such an arrangement will generate a resultant beam or, for reception, a sensitivity lobe, which is intermediate the beams or lobes which would be generated by the two arms individually. In such an antenna, it is preferable to couple the inner ends of the remaining arms to ground by way of a phase shifter which will provide the said phase relationship. The phase shifters of the remaining arms could then be shorted to ground as needed.

The mode currents traveling along the spiral arms radiate the electromagnetic energy of the first mode when the arms cross a circle of radius $\lambda/2\pi$; radiate the second mode when they cross a circle of radius $2\lambda/2\pi$, and so on. When the antenna is made of N-arms that are angularly separated at the inner ends by $2\pi/N$, the said feed arrangement generates N-azimuthal modes on the antenna arms, and when the antenna arms continue winding until they cross a circle of radius $N\lambda/2\pi$, the electromagnetic energy of the $N^{th}$ azimuthal mode, i.e. the last mode, radiates. With the said antenna, a single high gain beam is generated when all of the said azimuthal modes radiate in equal electrical phase, that is controlled by the electrical length of the conductive arms of the antenna between consecutive circles of radius $\lambda/2\pi$, $2\lambda/2\pi$, $3\lambda/2\pi$, and so on.

The said radio frequency energy may alternatively be fed to the outer end of the, or each, spiral arm, instead of its inner end, in which case the outer ends of the remaining spiral arms are connected to the ground, open-circuit, or coupled via phase shifters. In this case, the currents caused on the spiral arms travel inwards and radiate first the energy of the $N^{th}$ azimuthal mode, on a circle of radius $N\lambda/2\pi$ and continue inwards until the energy of the 1" mode radiates on a circle of radius $\lambda/2\pi$ near the inner ends of the spiral arms.

Advantageously, the width of the outer end portion of each arm may be enlarged gradually towards its end, thereby enhancing the radiation to radiate the remaining electromagnetic energy and inhibiting or reducing the reflection of the electromagnetic energy which would reduce the antenna gain.

The antenna spiral arms may conveniently be printed on a thin dielectric substrate thereby reducing the weight and cost.

Commutation means may be provided to cause the means for communicating radio frequency signals to communicate such radio frequency signals sequentially via each of the arms in succession, thereby to rotate the antenna beam, causing beam scanning.

Such commutation means may be employed where, as mentioned previously, the signals are communicated via at least two adjacent spiral arms, with an appropriate phase relationship, to generate and scan an intermediate beam. In addition, selectively disabling the phase shifter permits both "original" beams and intermediate beams to be provided, halving the scan intervals.

Signals received via several, for example three, adjacent arms may be compared by a comparator to determine the direction of arrival of a transmitted signal, thereby facilitating connection of the receiver to the end of the arm or arms which would maximize reception.

Advantageously, the antenna arms may be disposed adjacent a conductive ground plane, conveniently at a distance of between $\lambda/4$ and $\lambda/2$, so that radiation occurs only away from the ground plane.

In one preferred embodiment of the invention, there is provided an antenna comprising multiple conductive spiral arms and a radio frequency source. Each arm has an inner end and an outer end and the inner ends are displaced angularly around a circle about the rotation axis to angularly separate arms relative to each other. One of the arms is fed at its inner end from said radio frequency source. All inner ends of other arms are electrically connected to the ground and all outer ends are electrically open circuit, thereby generating simultaneously all azimuthal mode currents on the arms.

BRIEF DESCRIPTION OF DRAWINGS

Further objects and features of this invention will become clear from the following description of preferred embodiments, which are described by way of example only and with reference to the accompanying drawings.

DESCRIPTION OF PREFERRED EMBODIMENTS

Figure 1:
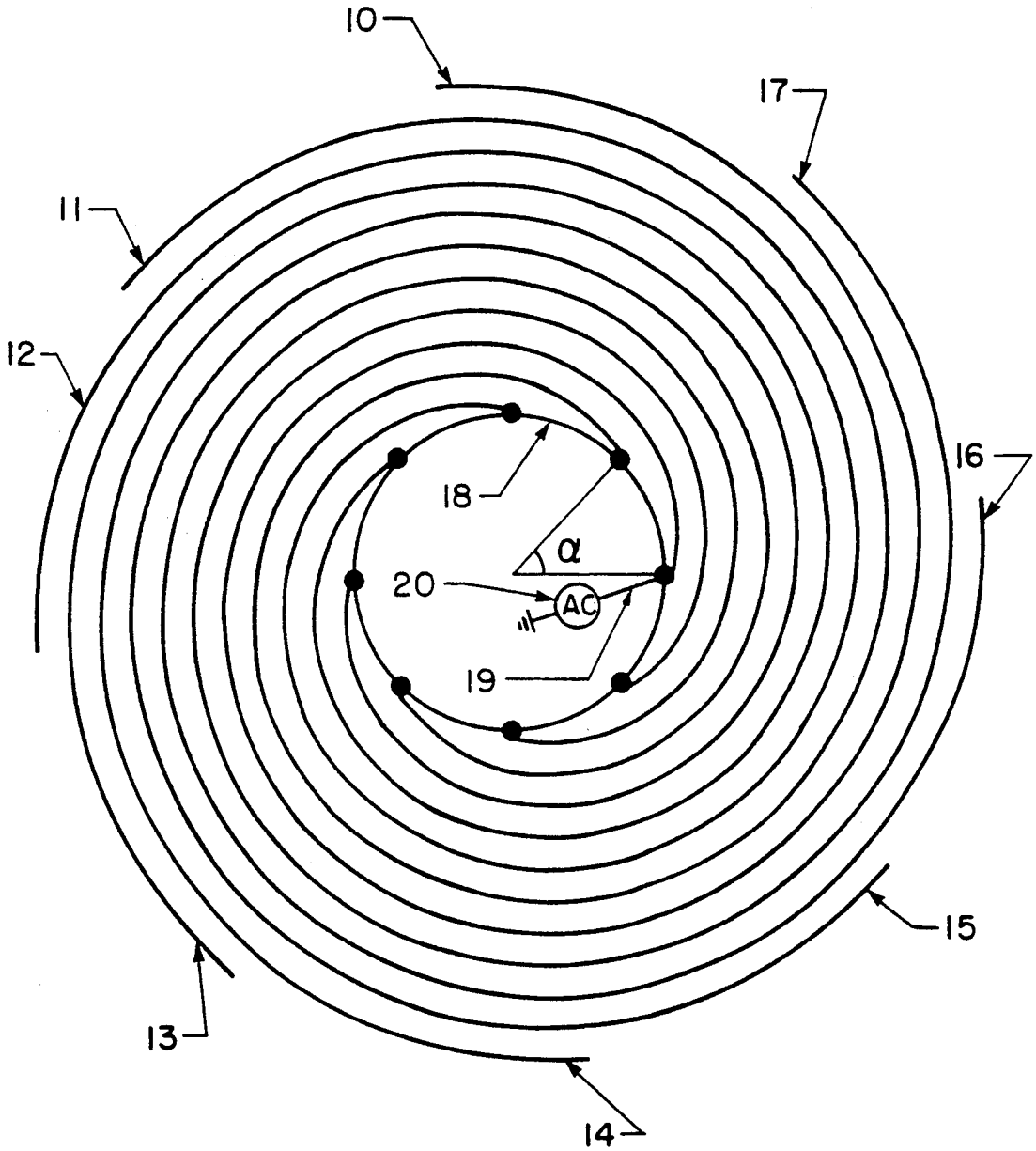
FIG. 1 is a plan view of an antenna having several spiral arms radiating from a common rotational axis and a coplanar ground plane, the inner end of one arm being fed and the inner ends of the remaining arms being open circuit.

Referring to FIG. 1, an antenna comprises eight spiral conductive arms 10 to 17, with a common axis of rotation, each arm having an inner end on an inner circle 18 and curving spirally outwards. The arms 10–17 are equally spaced about the axis of rotation. For the eight arm antenna of FIG. 1, the angular separation o between two adjacent arms on the inner circle will be equal to $2\pi/8$ radians. Generally, for an antenna having N arms, the angular separation $\alpha$ is $2\pi/N$ radians. Arm 10 is connected by a feed cable 19 to a radio frequency source 20 for supplying radio frequency signals with a wavelength $\lambda$. The inner ends of the remaining arms 11–17, and the outer ends of all eight arms, are open-circuit.

Figure 2:
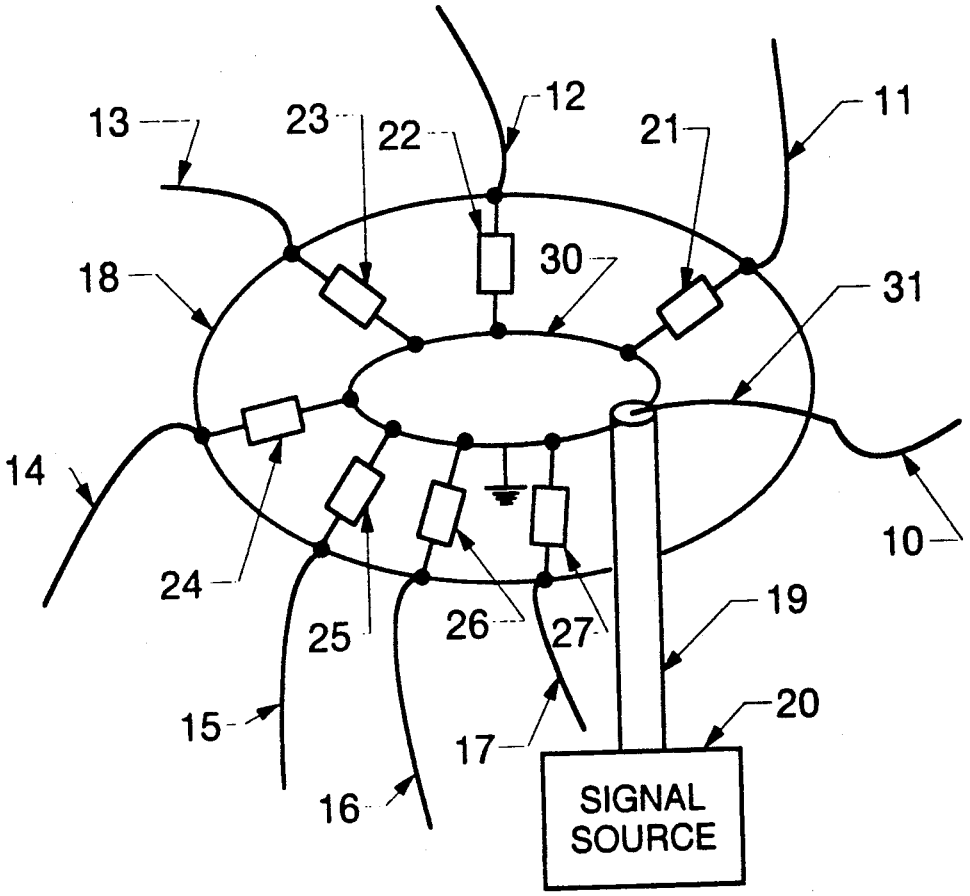
FIG. 2 is an enlarged view of the inner section of the antenna depicting the feeding configuration and showing, as an alternative, the inner ends of the remaining arms coupled to ground via coupling circuits.

As illustrated in FIG. 2, which shows in more detail the antenna connections at the inner ends of the spirals arms, the inner ends of the seven arms 11 to 17 may be electrically connected to the ground by coupling circuits 21 to 27, respectively. These coupling circuits may simply be short-circuits. Where more than one arm is fed, however, as will be described later, it might be preferable for the coupling circuits 21 to 27 to be phase shifters. A conductive circular disc 30 concentric with the feed circle 18 and connected to the outside shield of the feed cable 19, comprises a common electrical ground. The inner ends of the remaining spiral arms 11 to 17 are coplanar with the ground plane 30. The centre conductor 31 of feed cable 19 connects the signal source 20 to the inner end of spiral arm 10.

Figure 3:
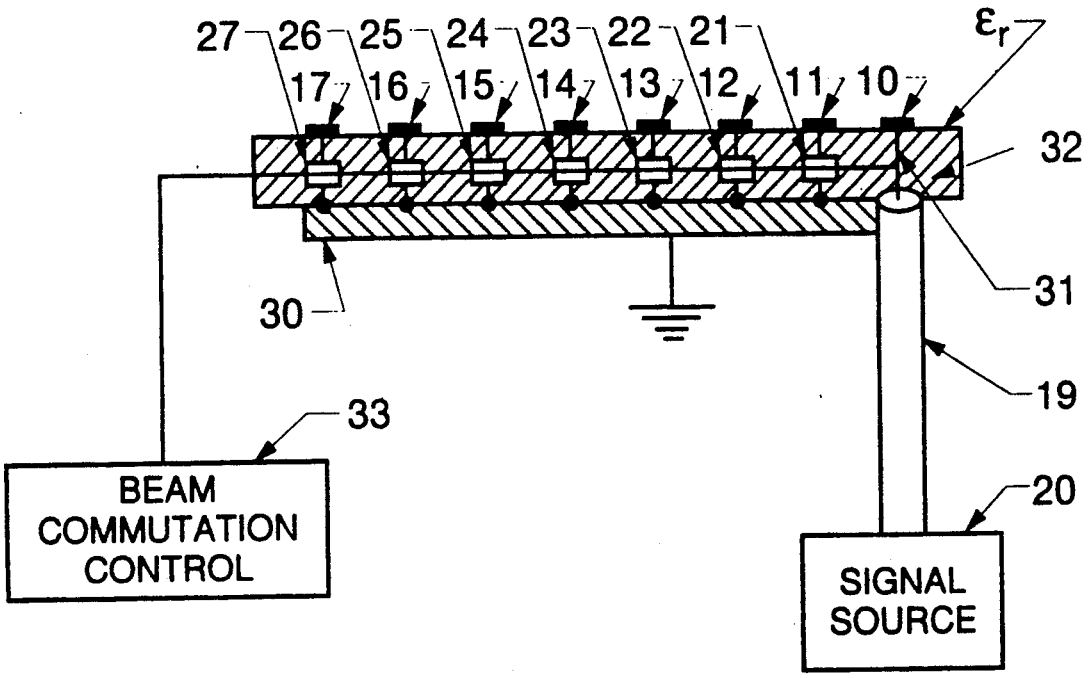
FIG. 3 is a developed cross-sectional view of the inner section of an antenna similar to the antenna of FIG. 2, but with the arms printed on one side of a dielectric substrate and the ground plane printed on the opposite side, the inner section being "unwound" to show the connections.
Figure 4:
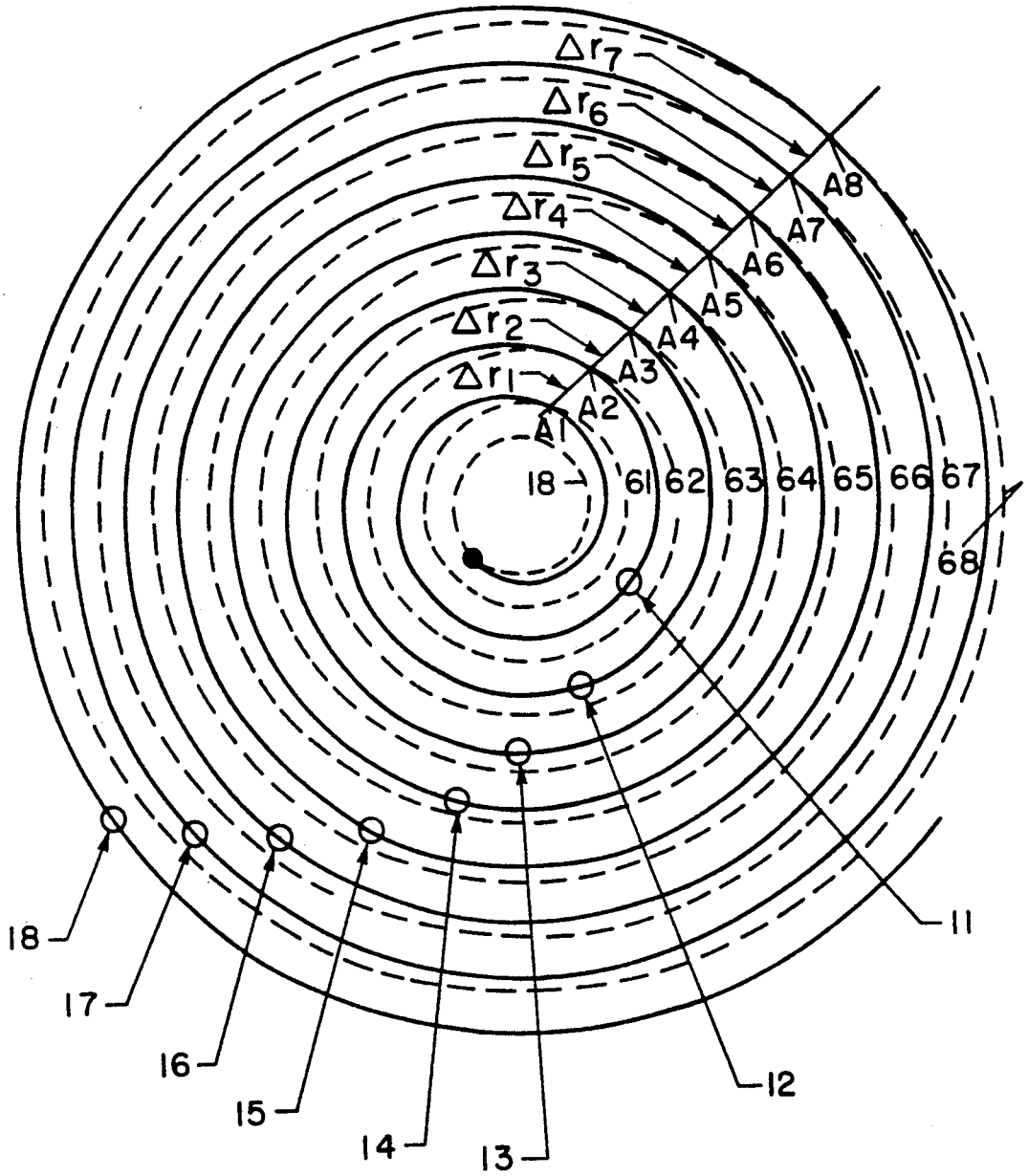
FIG. 4 shows the configuration of one of the arms as it winds through different radiating circles.

In the alternative antenna construction shown in FIG. 3, which is a cross-section of the feed region with the inner region developed or "unwound" to show the details of connections, the ground plane 30 is printed on the lower surface of the substrate 32 and coextensive with the feed circle 18. The spiral arms are printed on one side of a dielectric substrate 32. In FIG. 4, one of the arms, 10, is shown winding through radiation circles 61 to 68 of the azimuthal modes. The radius of circle 61, for the first mode, is $\lambda/2\pi$, the radius of circle 62, for the $2^{nd}$ mode, is $2\lambda/2\pi$, and so on to a radius $8\lambda/2\pi$ of circle 68 for the 8th mode. The arm 10 intersects circles 61 to 68 at so-called "active regions" $A_1, A_2, A_3, \ldots A_8$, respectively.

As illustrated in FIG. 4, in operation, the current launched on arm 10 by the signal source 20 travels outwards from the feed point, the inner end of the arm 10, and radiates the energy of each mode near the intersection points $A_1$, $A_2$, $A_3$, etc., exciting eight azimuthal modes.

To generate a high gain directional beam, the geometry of the antenna conductive arms 10 to 17 is arranged so that the radiated fields of these eight azimuthal modes are in equal electrical phase. Hence, the electrical length $l_2$ of the arm 10 between points $A_2$ and $A_3$ is equal to the length $l_1$ of the arm 10 between points $A_1$ and $A_2$ plus an integer multiple of the wavelength $\lambda$. The electrical length $l_3$ of the arm 10 between points $A_3$ and $A_4$ is equal to the length $l_2$ of the arm 10 between points $A_2$ and $A_3$ plus an integer multiple of the wavelength $\lambda$, and so on for the other arms.

Referring again to FIG. 4, $\Delta r_1$ is the increment of the radial distance between $A_1$ and $A_2$, $\Delta r_2$ is the increment of radial distance between $A_2$ and $A_3$, and so on. Since these points are on the radiating circles of radii $\lambda/2\pi$, $2\lambda/2\pi$, $3\lambda/2\pi$, . . . , then for an eight arm antenna:

$$\Delta r_1 = \Delta r_2 = \ldots = \lambda/2\pi = \text{constant}$$

Integration of this equation gives $$r = A + B\phi \qquad (1)$$

where r and $\phi$ are the radial distance and azimuthal angle, respectively, in a conventional polar coordinate system and A and B are constants. Equation (1) is the mathematical equation of a spiral in polar coordinates. The condition for generating in-phase radiation of azimuthal modes, as indicated previously, is that the length of the arm 10 between points $A_3$ and $A_2$ must be equal to its length between $A_2$ and $A_1$ plus the wavelength $\lambda$. This condition is not satisfied exactly by the conventional spiral of equation (1), but is approximately correct, which is satisfactory in practice.

If it is desired to satisfy this condition exactly, the spiral constants A and B in equation (1) may be adjusted after each circle crossing of $A_2$, $A_3$, etc., so that the radial separation is the same and the spiral arm length between azimuthal zones is an integer multiple of wavelength $\lambda$, thus resulting in a variable pitch spiral.

Referring again to FIG. 3, the coupling circuits 21 to 27 and the connection 31 to the signal source 20 are controlled by a beam commutation control circuit 33 which controls them to cause scanning of the antenna beam. The control circuit 33 may conveniently transfer the feed 31 from one spiral arm to the next, in sequence, in which case the beam will rotate through 360 degrees in eight equal steps. The arm from which the feed has been removed, and the remaining arms, will have their respective coupling circuits 21 to 27 grounded. (For convenience of illustration, the coupling circuit for arm 10 is not shown).

Figure 5:
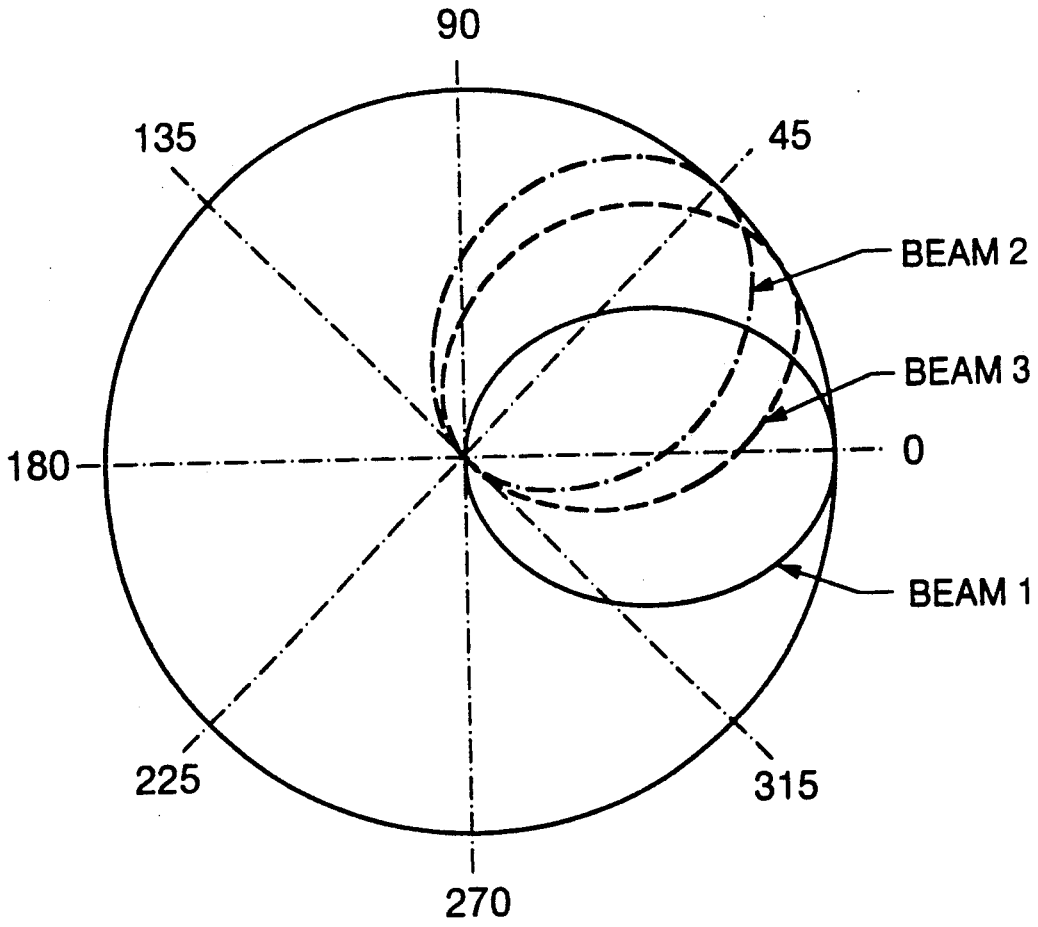
FIG. 5 is a polar plot illustrating scanning of the antenna beam by feeding two adjacent arms to generate adjacent beams.

Connecting the source 20 to the first spiral arm 10 and electrically shorting the rest, as mentioned previously, generates the electrical currents of eight azimuthal modes in the spiral arms. By selecting the geometry of the spiral arms as indicated previously, to cause the in-phase radiation of the signal from these eight azimuthal modes, a single high gain beam is radiated. Connecting the signal source 20 to the second arm 11 and shorting the rest generates a similar beam but rotated by an angle 45 degrees relative to the first beam. FIG. 5 shows the generated beams for the single arm feed of FIG. 4, beam 1 being generated by feeding arm 10 and beam 2 by feeding arm 11. The direction of beam rotation is from arm 10 towards arm 11. Repeating the process through arms 12 to 17, in sequence, feeding each individual arm in turn, generates eight separate beams each one rotated 45° about the spiral axis relative to the previous beam.

Alternatively, connecting the source 20 to the arm 10 and leaving the corresponding ends of the remaining arms electrically open circuit also generates the electrical currents of all eight azimuthal modes in the spiral arms, thereby generating a single high gain beam yet in another direction.

The coupling circuits 21 to 27 may comprise conventional phase shifting circuits which are variable between one extreme, at which the phasing network connects the respective arm directly to the electrical ground 30, and the other extreme, at which the arm is disconnected completely, thereby enabling different phase shifts in currents in the different antenna arms 10–17. In general, connecting the source 20 to one of the spiral arms and the remaining arms to the electrical ground, through the phasing networks, generates high gain beams that can be scanned by changing the phase shift setting in the phasing networks.

Figure 6:
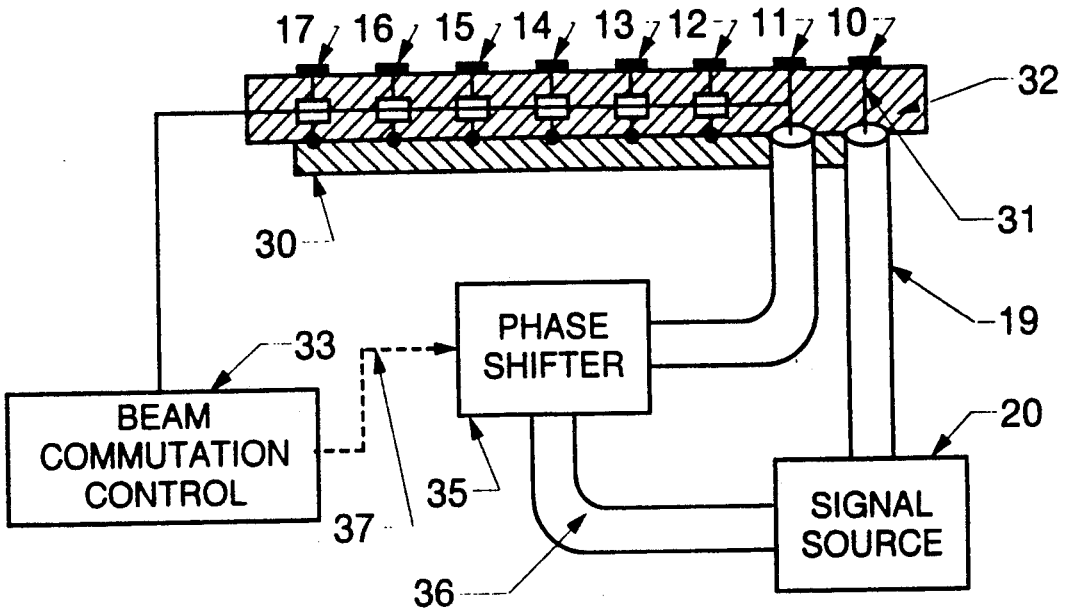
FIG. 6 is a view corresponding to FIG. 4, but of a modified antenna in which two adjacent arm inner ends are fed, one through a phase shifter, and with beam commutation circuitry.

In the alternative embodiment illustrated in FIG. 6, the inner ends of two adjacent arms 10 and 11 are connected to the signal source 20. The inner end of arm 10 is connected directly to the source 20 through the cable 19. The inner end of the next arm 11, however, is connected to the source 20 by way of a cable 34, phase shifter circuit 35 and cable 36. As a result, an intermediate high gain beam, beam 3 in FIG. 5, is generated half-way between the positions of beams 1 and 2 of the previous case where arms 10 and 11 were fed individually.

The beam commutation control circuit 33, may then commutate the feed of the two adjacent arms simultaneously, sequentially connecting the source 20 and the phase shifter 35 to successive pairs of arms 11 and 12, 12 and 13, and so on. At each step, the intermediate beam 3 generated will be displaced from the previous beam by an angle of 45 degrees about the spiral axis.

The control circuit 33' may be arranged to control also the phase shifter 35, as indicated by broken line 37, to coordinate connection of the arms 10 and 11 and interposing of the phase shifter 35 so as to generate, selectively, sixteen directional beams at angular intervals of 22.5 degrees.

In general, such feed arrangements allow an N arm antenna to generate 2N beams angularly separated by 180/N degrees. For the feed system of FIG. 6, the most appropriate phase shift value between the feeds to the two adjacent arms has been found by experiment to be $(N-1)\pi/N$ degrees, which for the eight arm antenna shown here becomes 157.5 degrees.

Figure 7:
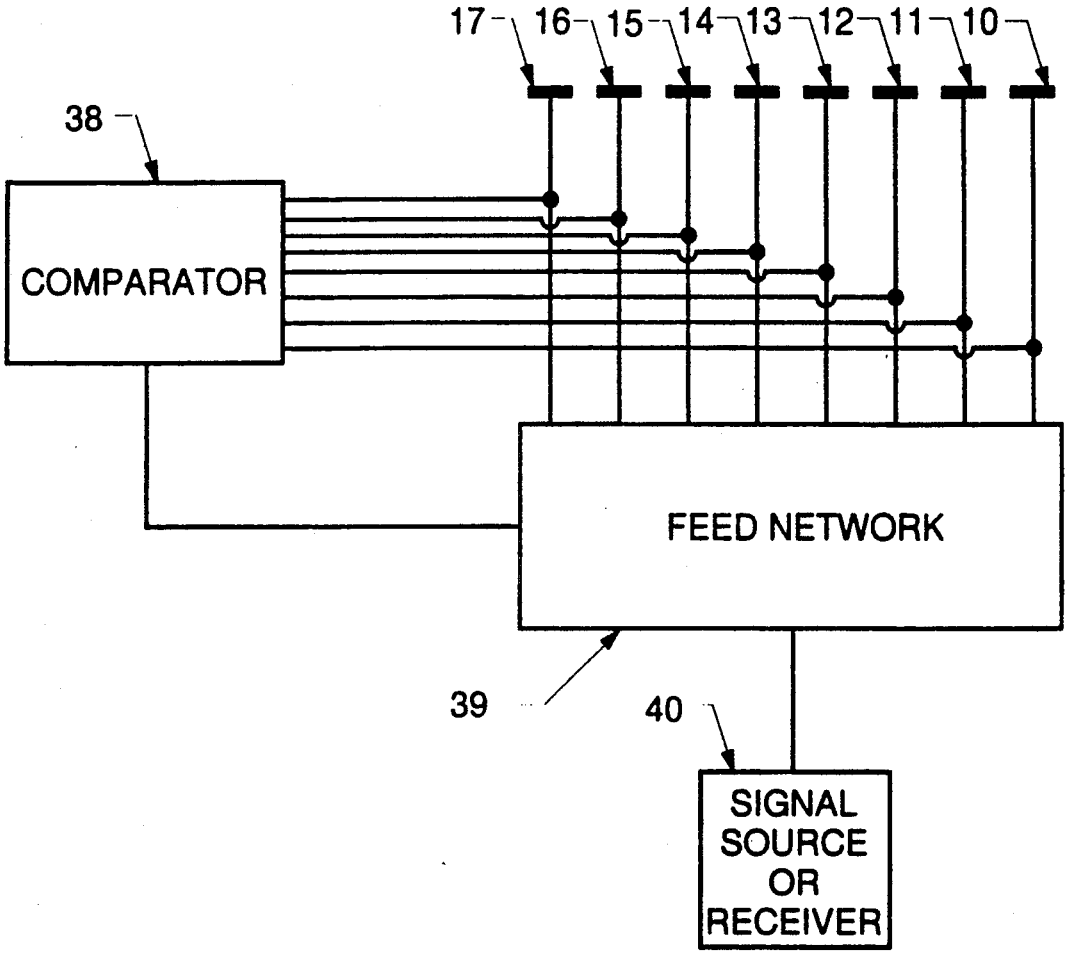
FIG. 7 is a schematic view of an antenna with a feed network and comparator arrangement for identifying the direction of arrival of a received signal.

It should be appreciated that, although the embodiments of FIGS. 1 to 6 include a signal source 20, and hence are for transmitting signals, a receiver could be substituted for the signal source 20 and the antenna used for reception When the antenna is used with a receiver, and the direction of arrival of the radio frequency wave is changing, it is desirable to determine to which of the spiral arms the receiver should be coupled for maximum signal reception. FIG. 7 illustrates an antenna arrangement in which the inner ends of the spiral arms 10 to 17 are connected to a comparator circuit 38 which compares, sequentially, the signals received from all of the arms 10 to 17 and selects the antenna arm with the maximum signal. The output of the comparator circuit 38 is connected to an antenna feed network 39 to cause it to connect the selected arm electrically to the receiver 40. It should be appreciated that receiver 40 could comprise a transmitter or transceiver which would use the selected arm to optimize transmission.

A feature of antennas embodying the present invention is the rotation of the high gain beam with frequency. Hence, if the frequency of the signal is changed, a different spiral arm may have to be selected if the beam or lobe orientation is to remain the same. Such a situation might arise, for example, where the antenna is being used with a transceiver and the transmission and reception frequencies are different. Alternatively, it might be desirable to transmit alternately in different directions.

Figure 8:
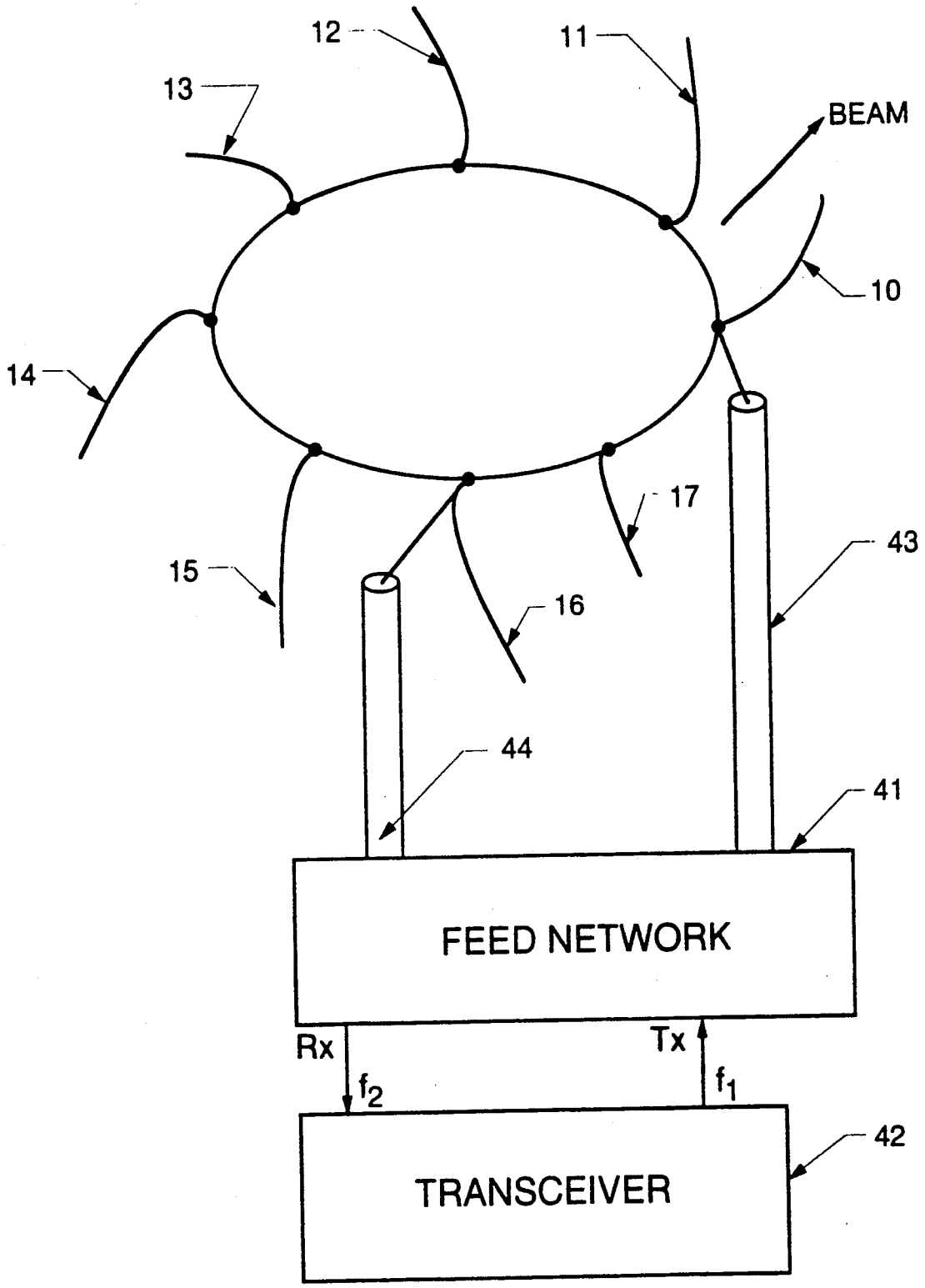
FIG. 8 illustrates an antenna with a feed network arranged for reception or transmission of radio frequency signals at two different frequencies.

FIG. 8 illustrates such an antenna arrangement in which a feed network 41 is connected to a transceiver 42 operable to transmit at frequency $f_1$ and receive at frequency $f_2$. The feed network 41 couples the transmit signal $f_1$ by way of cable 43 to spiral arm 10 and couples the received signal $f_2$ by way of cable 44 to spiral arm 16. The selection of the pair of spiral arms is made so that both arms provide a high gain lobe or beam in the same direction.

The rate of beam rotation with frequency is opposite to the direction of arm winding and depends upon the antenna parameters and operating frequency. For an antenna designed to operate with a first frequency $f_1$ of 3.2 GHz, its beam rotates approximately 45° for every 100 MHz of frequency change. That is, for the eight arm antenna of FIG. 8, in which the inner end of arm 10 is fed at $f_1$, the received signal should be derived from arm 16 when the received signal, at a frequency of 3.0 GHz., is received from the same direction as that in which the transmitted signal was transmitted. Clearly, transceiver 42 could be replaced by two sources operating at two different transmission frequencies.

Figure 9:
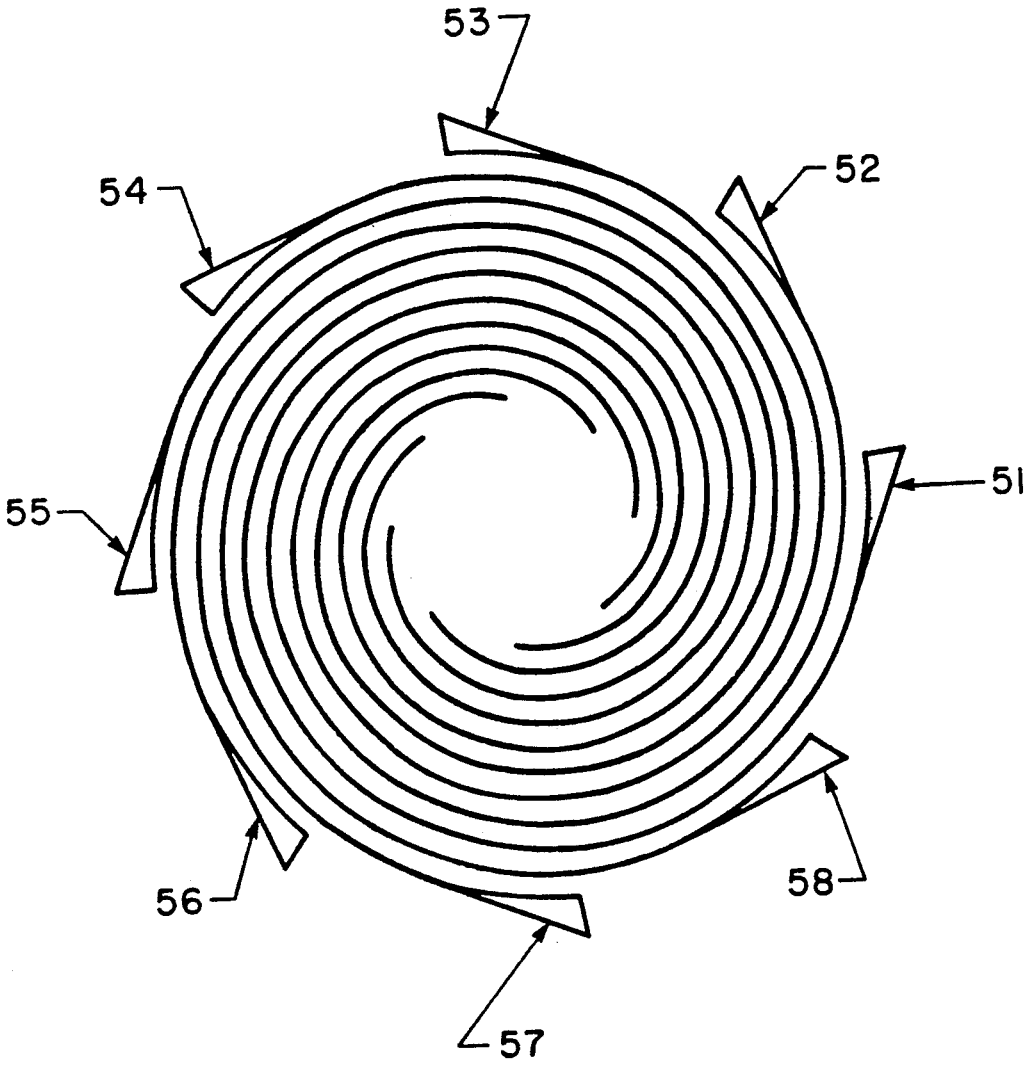
FIG. 9 is a plan view of an antenna in which the outer end portions of the spiral arms are triangular.

As indicated previously, with reference to FIG. 4, when a radio frequency source is connected to an N arm antenna, it launches electric currents of all N-azimuthal modes on antenna arms. These currents radiate the electrical power of each mode when they cross its radiating circle. However, the radiation zones are not exactly confined to radiating circles defined by their radii $\lambda/2\pi$, $2\lambda/2\pi$, . . . , but are distributed around them. Consequently, to completely radiate the antenna energy the antenna radius for an N-arm antenna may need to be much larger than $N\lambda/2\pi$. In practice, this requirement increases the antenna size. A modification to reduce the antenna radius to around $N\lambda/2\pi$, and yet force its currents to radiate fully, is illustrated in FIG. 9, which shows the outer end portions 51 to 58 of the antenna arms 10 to 17, respectively, formed generally triangular or wedge-shaped, with their widths increasing towards their ends. Such a gradual broadening of the conductive arms increases the radiation of the arms and reduces the reflection of the remaining electrical currents toward the inner arm ends. Since this reflected current rotates in the opposite direction, compared to the original arm current, its radiated field deteriorates the polarization of the radiated field. The preferred broadening of antenna arm ends in FIG. 9 depends on the antenna radius as compared to the theoretical value of $N\lambda/2\pi$ and must be increased for smaller antenna radii. In practice, the optimum dimensions can be determined by a measurement of the antenna radiated field and optimization of the antenna polarization. As an example, the electrical length of the triangular end portions may be substantially one quarter wavelength and their maximum width about three times the width of the spiral arm.

As an alternative to broadening the end portions of the arms, the length of each arm may be extended, say up to one half of a turn, beyond that needed for generating the required active regions. Such an extension will also have the effect of reducing reflections.

It is envisaged that, in use, the antenna will be positioned above a conductive reflecting plate, for example the roof of a vehicle, which will limit radiation to the upper hemisphere.

Although the embodiments of the invention described above comprise planar spiral arms, it is also envisaged that the spiral arms could be conical. This might be achieved by forming the spiral arms upon a conical substrate in place of planar substrate 32.

I claim:

1. An antenna comprising a plurality of spiral conductive arms having a common axis of rotation and their respective inner ends spaced angularly about such axis, and means for communicating radio frequency signal via one end of at least one, but not all, of said arms, respective outer ends of the spiral arms defining a periphery of the antenna, each arm having a plurality of turns, each turn intersecting a corresponding one of a plurality of concentric radiation mode circles, the respective circumferences of the radiation mode circles being integer multiples of a predetermined operating wavelength for the antenna, said intersecting takes place in a corresponding one of a plurality of active regions wherein radiation of the corresponding mode occurs when the antenna is communicating radio frequency signals at said predetermined operating wavelength, the winding rate of each antenna arm being such that each turn subsequent to the first turn has an electrical length substantially equal to the electrical length of a preceding turn plus an integer multiple of said wavelength.

2. An antenna as claimed in claim 1, wherein the arms are spaced at substantially equal intervals about said axis of rotation.

3. An antenna as claimed in claim 1, wherein the periphery of the antenna, defined by outer ends of the spiral arms, is substantially equal to the number of arms multiplied by said wavelength.

4. An antenna as claimed in claim i, wherein the end of said at least one of said arms opposite to said one end, and the corresponding ends of remaining arms, are open-circuit.

5. An antenna as claimed in claim wherein ends of remaining arms corresponding to said one end are open-circuit.

6. An antenna as claimed in claim 1, wherein said means for communicating radio frequency signals is coupled to an inner end of said at least one arm for communicating said signals.

7. An antenna as claimed in claim 1, further comprising means for coupling to a signal ground ends of said remaining arms corresponding to said one end of said at least one arm.

8. An antenna as claimed in claim 7, wherein said coupling means comprises phase shift circuits coupled to respective arms.

9. An antenna as claimed in claim 1, wherein said means for communicating radio frequency signals is arranged to communicate such signals via both said one of said arms and at least a second of said arms with a predetermined phase shift between the signals communicated via said one arm and said second arm.

10. An antenna element as claimed in claim 9, wherein the predetermined phase shift is $(N-1)\pi/N$, where N is the number of spiral arms.

11. An antenna as claimed in claim 1, wherein one end of each of several arms is connected to a comparator network, such network being operable to detect and compare signals received via such several arms, determine the arm communicating the maximum signal, and couple said means for communicating radio frequency signals to that arm.

12. An antenna as claimed in claim 1, wherein said means for communicating is arranged to communicate signals at two different frequencies via two spiral arms, respectively, said two spiral arms being selected according to the relationship between the angular separation of the two arms and the numerical difference between said two frequencies.

13. An antenna as claimed in claim 12, wherein said means for communicating serves to supply signals at one of said two frequencies to one of said two spiral arms and receive signals at the other of said two frequencies from the other of said two spiral arms.

14. An antenna as claimed in claim 1, wherein the means for communicating radio frequency signals comprises communication means for communicating such radio frequency signals selectively via different ones of the arms, thereby to displace the antenna beam about said common axis of rotation.

15. An antenna as claimed in claim 14, wherein the displacement means is operable to communicate said radio frequency signals sequentially via each arm in succession thereby to rotate the antenna beam about said common axis of rotation.

16. An antenna as claimed in claim 14, wherein the commutation means is operable to communicate said radio frequency signals sequentially via different pairs of arms in succession thereby to rotate the antenna beam about said common axis of rotation.

17. An antenna as claimed in claim 14, wherein said means for communicating radio frequency signals is arranged to communicate such signals via a pair of arms comprising said one of said arms and at least a second arm with a predetermined phase shift between the signals communicated via the said one arm and said second arm, and said commutation means is operable to communicate said radio frequency signals selectively via different pairs of said spiral arms, thereby to displace the antenna beam.

18. An antenna as claimed in claim 1, wherein the width of the outer end portion of each arm increases gradually towards its end.

19. An antenna as claimed in claim 18, wherein the electrical length of the outer end portion is substantially equal to a quarter of said wavelength, and its maximum width substantially three times the width of the conductive arm.

20. An antenna as claimed in claim 1, wherein said means for communicating comprises a signal source coupled to said at least one arm.

21. An antenna as claimed in claim 1, wherein said means for communicating comprises a signal receiver coupled to said at least one arm.

22. An antenna as claimed in claim 1, wherein said spiral arms define a conical surface.

23. An antenna as claimed in claim 1, wherein the means for communicating radio frequency signals comprises commutation means for communicating such radio frequency signals selectively via different ones of the arms, thereby to displace the antenna beam to angular displacements corresponding to the angular spacing of the respective inner ends, and, alternatively, via different pairs of arms with a predetermined phase shift between the signals communicated via the arms of a pair, thereby to displace the antenna beam to angular displacements intermediate the angular displacements resulting from communication via individual arms.

* * * * *